US005396739A

United States Patent [19]

Venegas, Jr.

[11] Patent Number: 5,396,739

[45] Date of Patent: Mar. 14, 1995

[54] GUARD RAIL ASSEMBLY

[76] Inventor: Frank Venegas, Jr., 4165 Homestead, Howell, Mich. 48843

[21] Appl. No.: 179,090

[22] Filed: Jan. 10, 1994

[51] Int. Cl.[6] ..... E04H 3/04

[52] U.S. Cl. ..... 52/33; 52/174; 256/69; 256/65

[58] Field of Search ..... 52/174, 33; 256/1, 59, 256/65, 66, 69

[56] References Cited

U.S. PATENT DOCUMENTS

| | | | |
|---|---|---|---|
| 3,194,361 | 7/1965 | Thurman | 256/65 X |
| 3,246,879 | 4/1966 | Case et al. | 256/65 X |
| 4,225,120 | 9/1980 | McLaughlin | 256/65 X |
| 4,266,757 | 5/1981 | Kirkwood | 256/65 |
| 4,647,016 | 3/1987 | Doublet | 256/1 X |
| 4,787,603 | 11/1988 | Norton | 256/1 X |
| 5,170,996 | 12/1992 | Venegas, Jr. et al. | 256/65 X |
| 5,213,312 | 5/1993 | MacDonald | 256/1 X |

*Primary Examiner*—Lanna Mai

*Attorney, Agent, or Firm*—Gifford, Krass, Groh, Sprinkle, Patmore, Anderson & Citkowski

[57] ABSTRACT

A guard rail assembly having a sheath formed of polymerized material, such as plastic. A panel set within the rail structure is also formed of a polymerized material, such as plastic. The sheathing about the guard rail assembly creates a protective coating eliminating repainting of the guard rail assembly and further preventing damage to the guard rail and impacting devices.

16 Claims, 1 Drawing Sheet

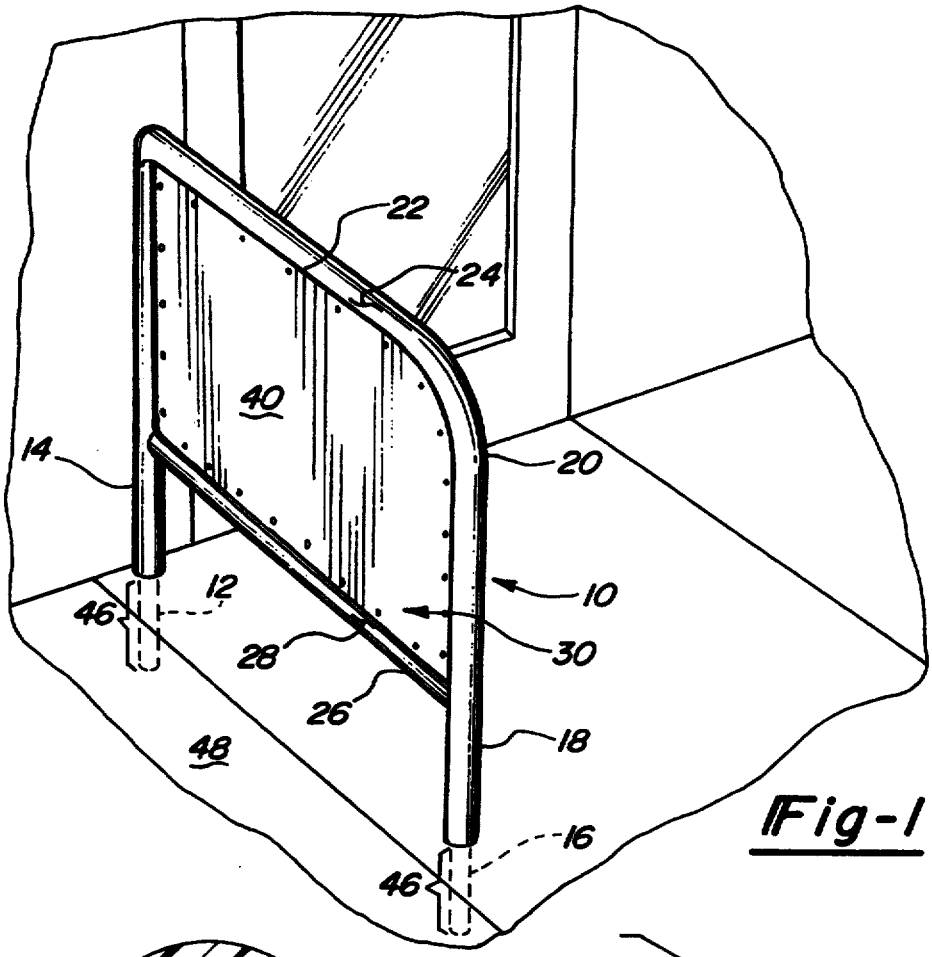
Fig-1
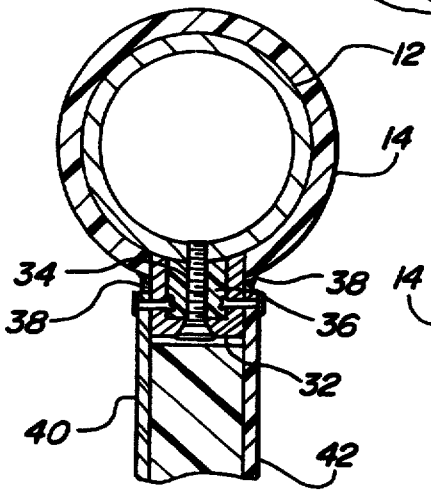
Fig-2
Fig-3
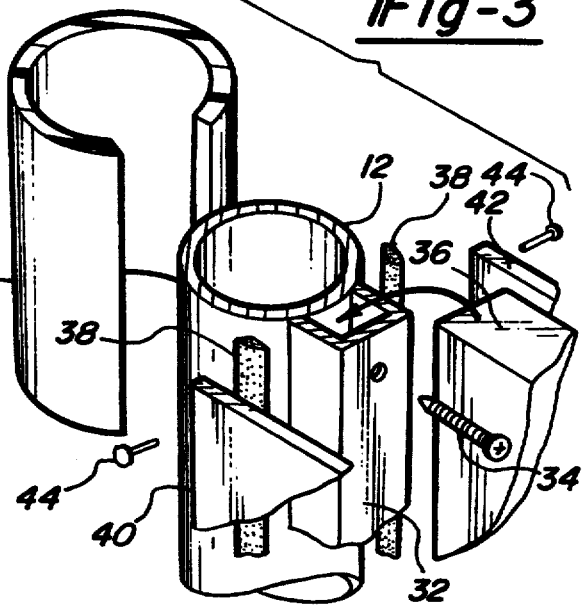

GUARD RAIL ASSEMBLY

BACKGROUND OF THE INVENTION

I. Field of the Invention

The present invention relates generally to a guard rail assembly. More particularly, the present invention relates to a guard rail assembly encased in a plastic sheath for use between an entrance way and an exit way in a general store setting.

II Description on the Relevant Art

Many guard rail assemblies in use today are constructed of metal, such as steel, encoated with paint or metal plating.

These guard rail assemblies are used to establish a boundary, such as a corral for grocery carts, or as a divider between an exit and entrance ramp, or an aisle way in a general store. The disadvantage of these painted or metal plated guard rails assemblies is that the guard rail may rust due to weather conditions or general use. Therefore, the guard rail must continually be repainted to protect from rust and upkeep the appearance.

A further disadvantage of these previously known guard rail assemblies is that any object bumping into the guard rail assembly will cause a dent or chip the paint on the guard rail. To repair the guard rail, the indentation must be bumped out and the rail repainted to prevent the metal from rusting.

SUMMARY OF THE PRESENT INVENTION

The present invention relates to a guard rail assembly provided with a sheath formed of a polymerized material, such as plastic, about the rail structure itself. A panel set within the rail structure is also formed of a polymerized material, such as plastic.

The guard rail assembly of the present invention is comprised of vertical and horizontal stanchions forming a quadrilateral frame. Each stanchion is sheathed in a polymerized material, such as plastic, to create a protective cover. The polymerized material may be formed into any color desired by the end user.

A U-shaped channel extends from the polymerized sheath about the interior of the guard rail frame Insulating material, such as Styrofoam TM, is set inside the U-channel and a second insulating material, such as weather-stripping, extends about the exterior of the U-channel. A panel formed of a polymerized material is fixedly attached to the U-channel on both sides of the U-channel. The Styrofoam TM and weather-stripping insulators create a watertight seal between the polymerized panel and sheaths. The polymerized panel can be formed of any color desired by the end user.

An advantage of this new guard rail assembly is that polymerized sheathing provides a protective coating to the metal rail, thereby, eliminating any repainting of the rail that may be necessary due to weather conditions and general use.

A further advantage of this guard rail assembly is that the polymerized sheath and panel also prevent denting and damaging of the guard rail by and to devices such as grocery carts. The guard rail assembly retains its structure and color throughout the lifetime of use.

Other advantages and features of the present invention will become more apparent from the following detailed description when read in conjunction with the accompanying drawing.

BRIEF DESCRIPTION OF THE DRAWINGS

The present invention will be more fully understood by reference to the following detailed description of the preferred embodiment of the present invention, when read in conjunction with the accompanying drawing, in which like reference characters refer to like parts throughout the views, and in which:

FIG. 1 is a perspective view of a guard rail assembly according to the present invention associated therewith;

FIG. 2 is a partial cross-sectional view showing a portion of the guard rail assembly; and FIG. 3 is an exploded view of FIG. 2.

DETAILED DESCRIPTION OF THE PREFERRED EMBODIMENT OF THE PRESENT INVENTION

The drawing discloses the preferred embodiment of the present invention. While the configurations, according to the illustrated embodiment are preferred, it is envisioned that alternate configurations of the present invention may be adapted without deviating from the invention as portrayed. The preferred embodiment is discussed hereafter.

With reference now to FIG. 1, a guard rail assembly 10 is thereshown acting as a barrier between an entrance and an exit way.

Referring to both FIG.'s 1 and 2, a first vertical stanchion 12 is formed preferably of metal tubing. Vertical stanchion 12 is sheathed in a polymerized material 14. Sheath 14 if preferably formed with an internal radius having a diameter only slightly larger than the external radius of the stanchion 12. This tight fit of sheath 14 about the vertical stanchion 12 deters water from seeping between the stanchion 12 and the sheath 14, thereby preventing rusting of the stanchion 12.

A second vertical stanchion 16 is thereshown in FIG. 1, opposite first vertical stanchion 12. Second vertical stanchion 16 is also sheathed by a polymerized material, such as plastic, 18. The second vertical stanchion 16, and polymerized sheath 18, extend arcuately at 20 to form a first horizontal stanchion 22 having a polymerized sheath 24.

A second horizontal stanchion 26 is placed opposite first horizontal stanchion 22. Second horizontal stanchion 26 is also sheathed in a polymerized material 28.

As best shown in FIG. 1, vertical stanchions 12, 16, and horizontal stanchions 22, 26 form a quadrilateral shaped frame 30.

With reference now to FIG.'s 2 and 3, a U-shaped channel 32 extends about the interior of quadrilateral frame 30. U-shaped channel 32 is mounted to vertical stanchions 12, 16 and horizontal stanchions 22, 26, by any mechanical means such as screws 34. An insulating material 36, such as Styrofoam TM, is placed between U-shaped channel 32 and vertical stanchions 12, 16 and horizontal stanchions 22, 26. Insulating material 36 protects against water leakage and resulting rust that may occur from subjecting the guard rail assembly 10 to any environmental conditions.

Weather-stripping 38 is provided on both sides of U-shaped channel 32 and extends completely about the quadrilateral frame 30. Partitions 40, 42, preferably formed of a polymerized material, such as plastic or Kydex TM, is shaped to fit the interior of quadrilateral frame 30. Partitions 40, 42 are fixedly attached to U-shaped channel 32 by mechanical means, such as rivets 44. Partitions 40, 42 create a water repellant seal by sealing the weather-stripping 38 between the partitions 40, 42 and U-shaped channel 32.

Vertical stanchions 12 16 extend beyond polymerized sheaths 14, 18, as shown at 46 in FIG. 1. These extensions provide means for fixedly securing the guard rail assembly 10 to a support foundation, such as a cement sidewalk 48.

Guard rail assembly 10 is formed by placing the polymerized material 14, 18, 24, 28 about vertical stanchions 12, 16. Vertical stanchion 16, along with the polymerized sheath 18, is then bent arcuately at a point approximately equal to the overall length of first vertical stanchion 12. At point 20, second vertical stanchion 16 becomes first horizontal stanchion 22. Polymerized material 28 used to sheath second horizontal stanchion 26 is rounded at each end to create a tight fitting seal between sheath 28 and vertical sheaths 14, 18 Second horizontal stanchion 26 is then covered by the polymerized sheath 28 and fixedly attached to vertical stanchions 12, 16, by any standard mechanical means. Second horizontal stanchion 26 is attached to vertical stanchions 12, 16 opposite horizontal stanchion 22 to create a quadrilateral frame 30.

Insulating material 36 is placed within a U-shaped channel 32 and then fixedly secured about the quadrilateral frame 30. Weather-stripping 38 extends on either side of U-shaped channel 32 and is self-adhesive to U-shaped channel 32. Partitions 40, 42 are then set adjacent weather-stripping 38 and fixed to U-shaped channel 32 by any mechanical means, such as rivets 44.

The guard rail assembly 10 is then shipped to the end user where it may be secured into a position by vertical stanchion extensions 46.

Having described my invention, however, many modifications thereto will become apparent to those skilled in the art to which it pertains without deviation from the spirit of the invention as defined by the scope of the appended claims.

I claim:

1. A rail assembly comprising:

a first vertical stanchion having a polymerized sheath;

a second vertical stanchion opposite said first vertical stanchion and having a polymerized sheath;

wherein said second vertical stanchion and said polymerized sheath extend arcuately to form a first horizontal stanchion having a polymerized sheath;

a second horizontal stanchion opposite said first horizontal stanchion and having a polymerized sheath;

wherein said first and second vertical stanchions and said first and second horizontal stanchions form a quadrilateral frame;

wherein said vertical and horizontal stanchions comprise a U-shaped channel extending about the interior of said quadrilateral frame.

2. The rail assembly defined in claim 1, wherein said channel is fixedly mounted to said horizontal and vertical stanchions.

3. The rail assembly defined in claim 1, wherein said U-shaped channel further comprises insulating material within said channel.

4. The rail assembly defined in claim 1 and further comprising insulating means extending between said channel and said vertical and horizontal stanchions and extending about said quadrilateral frame.

5. The rail assembly defined in claim 4 and further comprising a polymerized partition housed within said quadrilateral frame and resting on said insulating material.

6. The rail assembly defined in claim 5, wherein said polymerized partition is fixedly secured to said channel.

7. The rail assembly defined in claim 1, wherein said stanchions are tubular.

8. The rail assembly defined in claim 1, wherein said sheaths are tubular.

9. The rail assembly as defined in claim 1, wherein said first and second vertical stanchions extend beyond said horizontal stanchions and further comprising means for fixedly securing said rail assembly to a support foundation.

10. A rail assembly comprising:

a first vertical tubular stanchion having a polymerized tubular sheath;

a second vertical tubular stanchion opposite said first vertical tubular stanchion and having a polymerized tubular sheath;

wherein said second vertical tubular stanchion and said polymerized tubular sheath extend arcuately to form a first horizontal tubular stanchion having a polymerized tubular sheath;

a second horizontal tubular stanchion opposite said first horizontal tubular stanchion and having a polymerized tubular sheath;

wherein said first and second vertical tubular stanchions and said first and second horizontal tubular stanchions form a quadrilateral frame;

wherein said vertical and horizontal tubular stanchions comprise a U-shaped channel extending about the interior of said quadrilateral frame.

11. The rail assembly defined in claim 10, wherein said channel is fixedly mounted to said horizontal and vertical tubular stanchions.

12. The rail assembly defined in claim 10, wherein said U-shaped channel further comprises insulating material within said channel.

13. The rail assembly defined in claim 10 and further comprising insulating means extending between said channel and said vertical and horizontal tubular stanchions and extending about said quadrilateral frame.

14. The rail assembly defined in claim 13 and further comprising a polymerized partition housed within said quadrilateral frame and resting on said insulating material.

15. The rail assembly defined in claim 14, wherein said polymerized partition is fixedly secured to said channel.

16. The rail assembly as defined in claim 10, wherein said first and second vertical tubular stanchions extend beyond said horizontal tubular stanchions and further comprising means for fixedly securing said rail assembly to a support foundation.

* * * * *